US007779587B1

(12) United States Patent
Meyer

(10) Patent No.: US 7,779,587 B1
(45) Date of Patent: Aug. 24, 2010

(54) RAISED FLOOR ACCESS PANEL

(76) Inventor: Gary Meyer, 25813 Gateway Dr., Golden, CO (US) 80401

( * ) Notice: Subject to any disclaimer, the term of this patent is extended or adjusted under 35 U.S.C. 154(b) by 953 days.

(21) Appl. No.: 10/684,018

(22) Filed: Oct. 10, 2003

(51) Int. Cl.
*E04B 5/48* (2006.01)
*E04B 5/43* (2006.01)

(52) U.S. Cl. ..... 52/263; 52/127.8; 52/127.7; 292/336.3; 292/195

(58) Field of Classification Search ..... 52/127.5, 52/127.7–127.9, 122.1, 125.1, 126.1–126.2, 52/126.5, 126.6, 263, 19, 20; 292/DIG. 11, 292/DIG. 13, 336.3, 195, 210, 203
See application file for complete search history.

(56) References Cited

U.S. PATENT DOCUMENTS 2,313,711 A * 3/1943 Jacobi ..... 70/145
2,867,301 A * 1/1959 Benton ..... 52/263
3,087,206 A * 4/1963 Delf et al. ..... 52/126.5
3,511,001 A * 5/1970 Morgan, Jr. ..... 52/126.5
3,581,532 A * 6/1971 Andersen et al. ..... 70/84
3,587,259 A * 6/1971 Sandor ..... 70/218
3,789,557 A * 2/1974 Harvey ..... 52/126.6
3,871,198 A * 3/1975 Miller ..... 70/489
3,899,857 A * 8/1975 Mochizuki ..... 52/126.6
RE28,756 E * 4/1976 Fork ..... 138/92
4,074,488 A * 2/1978 Ray, III ..... 52/263
4,258,516 A * 3/1981 Mori et al. ..... 52/126.6
4,278,031 A * 7/1981 Dangschat ..... 108/4
4,294,049 A * 10/1981 Young et al. ..... 52/20
4,348,841 A * 9/1982 Ueno et al. ..... 52/126.5
4,404,916 A * 9/1983 Ingram ..... 109/67
4,438,610 A * 3/1984 Fifer ..... 52/263
4,546,580 A * 10/1985 Ueno et al. ..... 52/126.1
4,558,544 A * 12/1985 Albrecht et al. ..... 52/126.6
4,593,499 A * 6/1986 Kobayashi et al. ..... 52/126.6
4,835,924 A * 6/1989 Blacklin et al. ..... 52/263
4,850,208 A * 7/1989 Weinerman et al. ..... 70/208
4,852,503 A * 8/1989 Lichter ..... 109/59 R
4,901,490 A * 2/1990 Zinniel et al. ..... 52/263
4,905,437 A * 3/1990 Heather ..... 52/263
4,922,670 A * 5/1990 Naka et al. ..... 52/126.6
4,924,639 A * 5/1990 Sato et al. ..... 52/167.2
5,049,700 A * 9/1991 Kobayashi et al. ..... 174/48
5,060,583 A * 10/1991 Stinson ..... 109/50
5,072,557 A * 12/1991 Naka et al. ..... 52/126.6
5,123,776 A * 6/1992 Lang et al. ..... 404/25
5,211,436 A * 5/1993 Feder ..... 296/76
5,293,725 A * 3/1994 Matticks et al. ..... 52/271

(Continued)

FOREIGN PATENT DOCUMENTS

GB 2250776 A * 6/1992

(Continued)

*Primary Examiner*—Phi Dieu Tran A
(74) *Attorney, Agent, or Firm*—Scott L. Terrell, P.C.; Scott L. Terrell

(57) ABSTRACT

A raised floor access panel is provided which includes a substantially flat panel having an upper load supporting surface and a lower surface to be supported on a plurality of pedestal support members each adjacent to a corner of the panel, and at least one panel lifter having a top wall and two side walls, the side walls slidably extending through a first and second slots in a plate rigidly attached to the lower surface for vertical travel of the top wall and side walls upwardly, through a generally rectangular panel recess.

5 Claims, 4 Drawing Sheets

U.S. PATENT DOCUMENTS 5,301,480 A * 4/1994 Oyama et al. ..... 52/126.6
5,459,968 A * 10/1995 Jin ..... 52/126.6
5,499,476 A * 3/1996 Adams et al. ..... 52/220.1
5,529,431 A * 6/1996 Walsh ..... 404/25
5,820,470 A * 10/1998 Saunders ..... 472/92
5,927,773 A * 7/1999 Larsen et al. ..... 292/337
6,240,752 B1 * 6/2001 Larsen et al. ..... 70/208
6,442,906 B1 * 9/2002 Hwang ..... 52/126.6
6,606,889 B1 * 8/2003 Tweedy ..... 70/208
6,783,163 B2 * 8/2004 Sadler ..... 292/341.18
6,983,570 B2 * 1/2006 Mead ..... 52/263
7,168,212 B2 * 1/2007 Jette ..... 52/220.5
7,360,343 B1 * 4/2008 Spransy et al. ..... 52/263

FOREIGN PATENT DOCUMENTS

JP 2-112574 * 4/1990 ..... 70/208

* cited by examiner

RAISED FLOOR ACCESS PANEL

CROSS REFERENCE TO RELATED APPLICATIONS

Not Applicable.

STATEMENT OF FEDERALLY SPONSORED RESEARCH

Not Applicable.

BACKGROUND OF THE INVENTION

1. Field of the Invention

The present invention relates to raised floor access panels. In particular, it relates to an interchangeable floor panel having leveling, lifting or locking devices.

2. Description of the Related Art

Raised floors are commonly used to create a space between a sub-floor and the normal working environment of a room. The sub-floor is the surface that would serve as the floor of a room before a raised floor has been installed. The space between the sub-floor and the raised floor is used to hold electrical wiring and fiber optic cables, to contain an air plenum chase, and more generally to contain anything that must be in a room but is more safely or conveniently enclosed in an area apart from the main area of the room.

Raised floor panels are generally of a solid design or have perforations to allow air flow. The perforated panels allow better ventilation than solid panels and provide a smoother working surface and greater strength than grills. The usual method to support a raised floor is to place a support pedestal under each corner of the floor panels. Innovations in raised floor support structures have focused on refinements in corner support systems. For example, U.K. Patent Application No. 2-267-720-A of Haung describes a system where the corner support pedestals are connected to one another by a grid. Another support system, describing U.S. Pat. No. 5,048,242 of Cline includes stringers attached between support pedestals. Again, the pedestals support the panels at their corners and additional support is achieved at the edges of the panels by the stringers. In a stringer system, the panels and stringers are attached to the pedestal heads using screws.

Various under-structure designs are utilized to support the panel and adjusting levelness of the top working surface is predominantly accomplished through a plurality of adjustable support pedestal heads. Panels are either gravity held or screwed to the adjustable pedestal head. Removal of the panels is accomplished by unscrewing the corner screws, where utilized, and lifting the panel with suction cup lifters. In cases of perforated air flow panels, no common industry standard is supplied for lifting devices which leads to the use of unsafe, non-compliant instruments such as a screwdriver, grasping hook, knives, needle-nose pliers and the like for removal and replacement.

Although the primary purpose of a panel is to structurally support an applied load, they must also be easily and safely removed and re-inserted. This is required for the relocation of work cubicles, equipment, wiring, cabling and air flow disbursement to appropriate heat load designs.

Moreover the use of gravity held panels or corner lock screw panels does not provide secure access to sensitive electronic highways. With either a suction cup lifter or screwdriver, any of the past or present floor panels can be easily removed providing unsecured access to what has become a central nervous system for a great many organizations.

Thus, what is needed is to provide a raised floor access panel which is interchangeable with a variety of floor panel systems together with an integrated lifting device for the safe removal and re-insertion of panels with a key lock system, if so desired. There is also a need for a panel having a screwless corner lock forcing the panel to an underside of an adjustable pedestal stantion. The present invention satisfies these needs.

BRIEF SUMMARY OF THE INVENTION

It is therefore an object of the present invention to provide a panel which is interchangeable with a variety of floor panel designs.

It is another object of the present invention to provide a panel having an integrated lifting device for the safe and easy removal and re-insertion of the panels.

It is another object of the present invention to provide a panel that achieves a positive corner lock between the panel and the underside of pedestal stantions.

It is yet another object of the present invention to provide a panel which incorporates a key entry lock for secured access to the sub-floor.

To overcome the problems of the prior art and in accordance with the purpose of the invention, as embodied and broadly described herein, briefly, a raised floor access panel is provided which includes a substantially flat panel having an upper load supporting surface and a lower surface to be supported on a plurality of pedestal support members each adjacent to a corner of the panel, and at least one panel lifter having a top wall and two side walls, the side walls slidably extending through a first and second slots in a plate rigidly attached to the lower surface for vertical travel of the top wall and side walls upwardly, through a generally rectangular panel recess.

Additional advantages of the present invention will be set forth in part in the description that follows and in part will be obvious from that description or can be learned from practice of the invention. The advantages of the invention can be realized and obtained by the apparatus particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and, together with the description, explain the principles of the invention.

DETAILED DESCRIPTION OF THE DRAWINGS

Unless specifically defined otherwise, all technical or scientific terms used herein have the same meaning as commonly understood by one of ordinary skill in the art to which this invention belongs.

Although any methods and materials similar or equivalent to those described herein can be used in the practice or testing of the present invention, the preferred methods and materials are now described. Reference now will be made in detail to the presently preferred embodiments of the invention, examples of which are illustrated in the accompanying drawings wherein like numerals represent like features.

Figure 1:
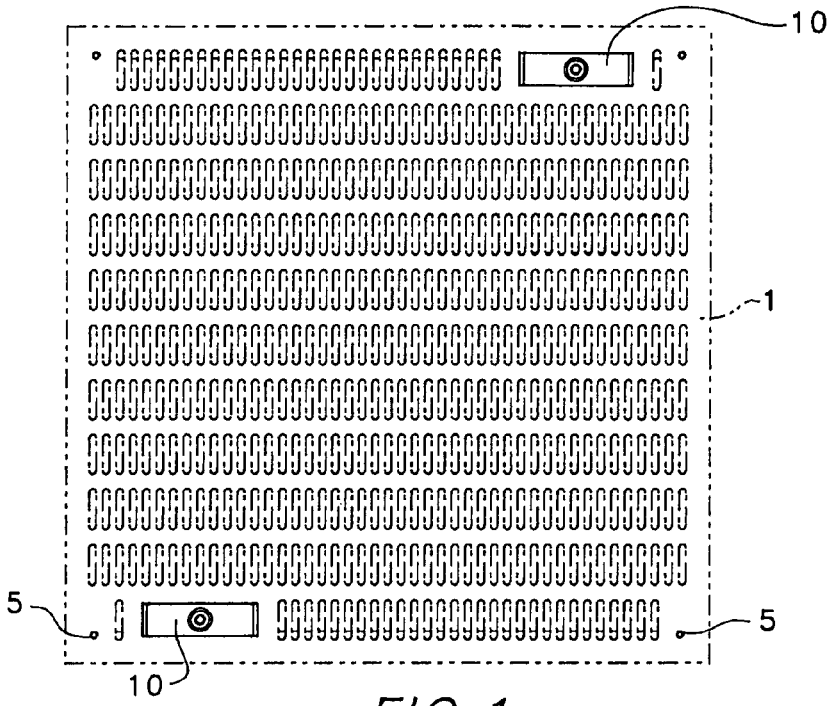
FIG. 1 is a top view of a perforated panel showing a preferred relationship to the panel lifters.
Figure 2:
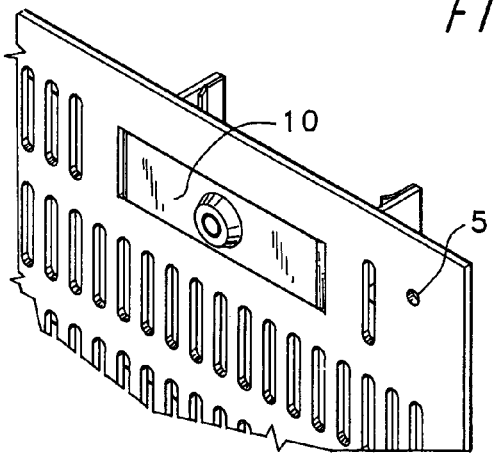
FIG. 2 is a perspective view of one embodiment of a panel lifter while locked in a closed position.
Figure 3:
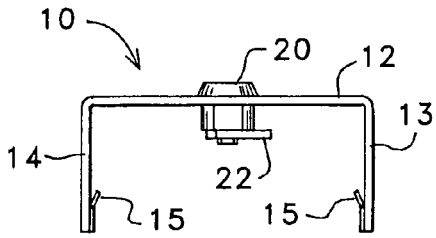
FIG. 3 is a side view of a panel lifter including one embodiment of the locking mechanism.
Figure 4:
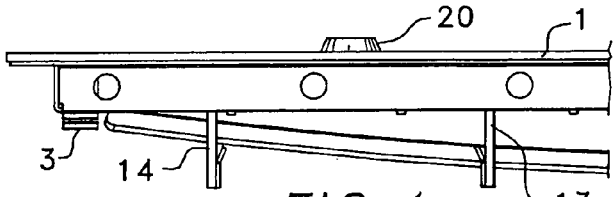
FIG. 4 is a side view of a panel lifter installed in a panel having a leveling device in accordance with the present invention.

The invention provides an interchangeable system for use with all raised access floor panels well known in the art. FIG. 1 is a top view of a perforated panel 1 showing a preferred arrangement of the integrated panel lifters 10 and panel levelers 5. As shown in FIGS. 2, 3, and 4, the panel lifters 10 include a top wall 12 and two side walls 13, 14. At the end of each side wall 13, 14 is a stop 15 which restricts the panel lifter 10 from traveling out of the panel 1 when removing or re-installing the panel in a floor matrix. As shown in the drawing figures, the panel lifter 10 may, but need not, include a locking mechanism 20. The first embodiment shown in these drawing figures is a key lock 20 centrally mounted in the top wall 12 of the panel lifter 10. The key locking mechanism 20 terminates in a locking tab 22 which, when the panel lifter top plate 12 is in a downward position substantially flush with a plate 30, attached to the underside of the panel with a rivet or weld, travels through a key shaped hole in the plate 36. The panel 1 is then locked to a pedestal 38 by inserting a key in the lock and turning the tab 22 against an underside of the plate 38 and removing the key.

Panel levelers 5 may, but need not, be provided at each corner of the panel 1 to adjust a distance between the pedestal head 38 and the underside-side of the panel. In this manner, the floor panel according to the present invention can be used to replace old or damaged panels of different thickness by adjusting the distance to a position where the panel top surface is on a plane with the existing raised floor panels of a different manufacture. The panel levelers are preferably a hex head threaded connector (not shown) through a collar extending through the corner hole 5 in the panel. The panel leveler desirably includes a foot 3 for resting on the pedestal. The foot 3 is adjustably moved in an upward or downward direction, relative to the panel, by turning a hex head driver through the hole 5 in the panel 1.

Figure 5:
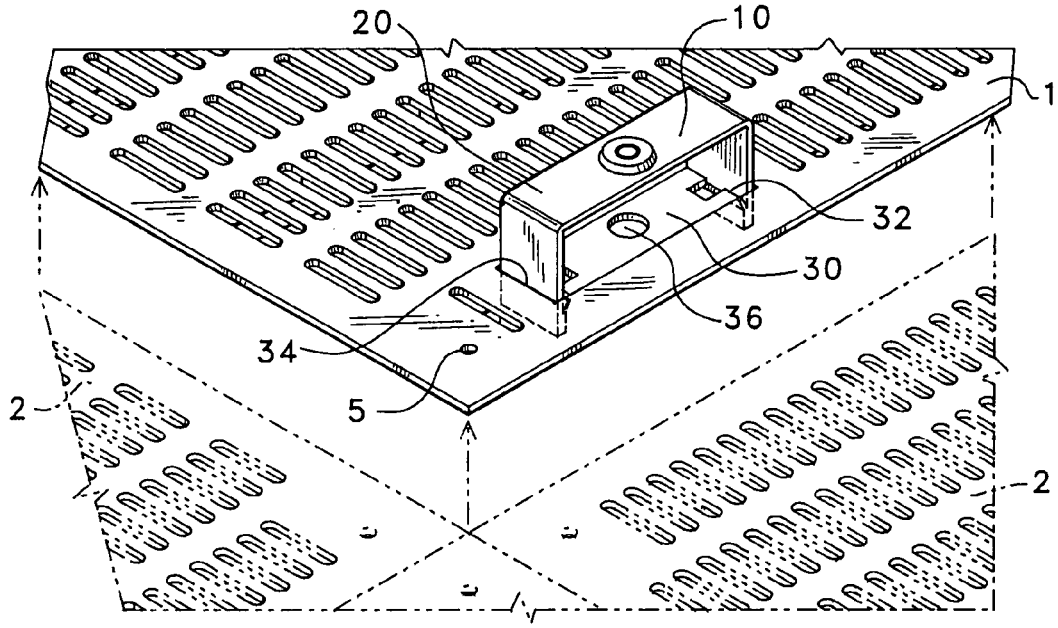
FIG. 5 is an exploded view of the panel lifter in a raised unlocked position in relation to other panels to form a raised floor matrix.

Turning now to FIG. 5, where it is shown an exploded view of the panel lifter 10 in a raised unlocked position relative to the other panels 2 previously installed to form a raised floor matrix. In the raised position, the stops 15 on the side wall ends 13, 14 engage a bottom plate 30 so that the panel lifter 10 does not slide out of the first 32 and second 34 slots in the plate 30.

Figure 6:
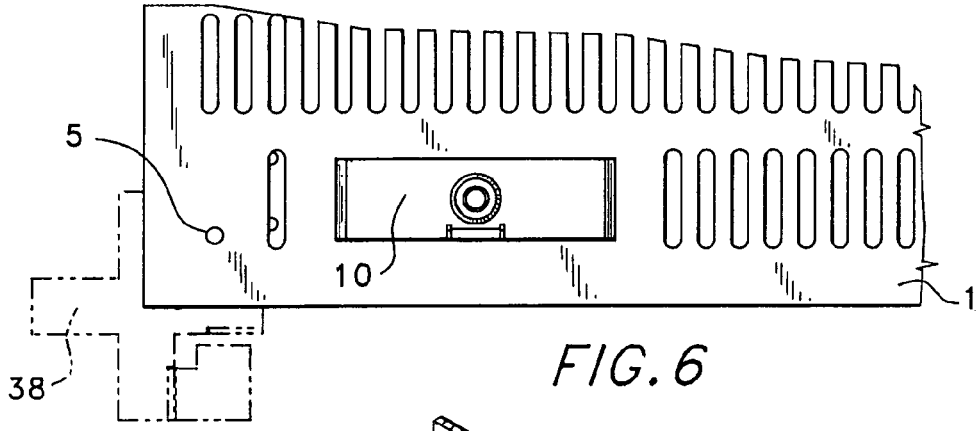
FIG. 6 is a top view of the panel lifter in a locked position showing the location of the panel leveler in relationship to the pedestal.
Figure 7:
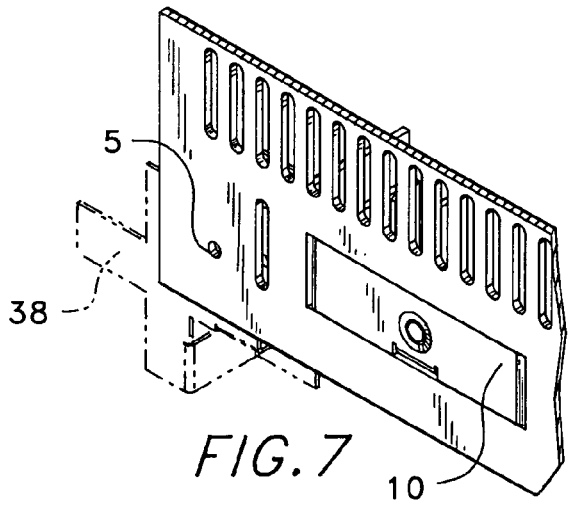
FIG. 7 is a perspective view of the illustration of FIG. 6.
Figure 8:
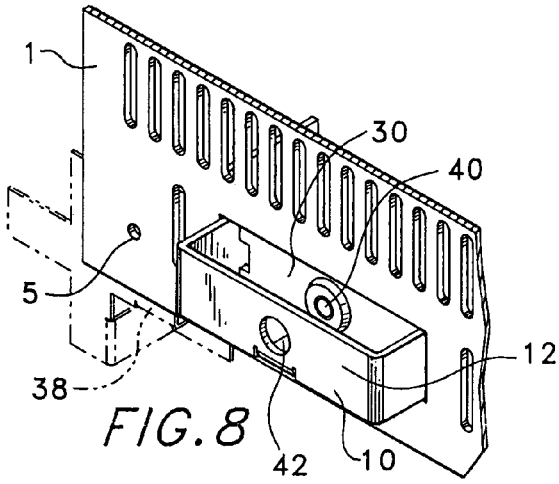
FIG. 8 is a perspective view of the illustration of FIG. 7 but showing the panel lifter in an open and unlocked position.

FIGS. 6, and 7 show a top and perspective view, respectively, of the panel lifter 10 in a locked position and the location of the panel levelers 5 in relationship to the adjustable pedestal head 38. FIG. 8 shows a perspective view of the plate 30 and a second embodiment of the locking mechanism 40, but shows the panel lifter 10 in an open and unlocked position.

The second embodiment of the locking mechanism and a preferred embodiment of the adjustable corner lock are illustrated in FIGS. 9, 10, 11, and 12. Here, the lock 40 is centrally mounted in the plate 30 with a hole 42 in the top plate 12 for key insertion. The hole 42 also serves as a finger grip for lifting the panel lifter 10 in an upward direction. In the plate 30, a third slot 46 is provided for receiving a latch member 44 attached to the underside of the top wall 12 of the panel lifter 10. Also attached to the underside of the plate 30 is a ninety degree angle bracket 45 for pivotal attachment of a lever arm 50 at a pivot point 54 on the angle bracket 45. At a first end 53 of the lever arm 50 is a cylindrical threaded housing 56 for adjustably receiving a threaded corner lock 58.

Figure 9:
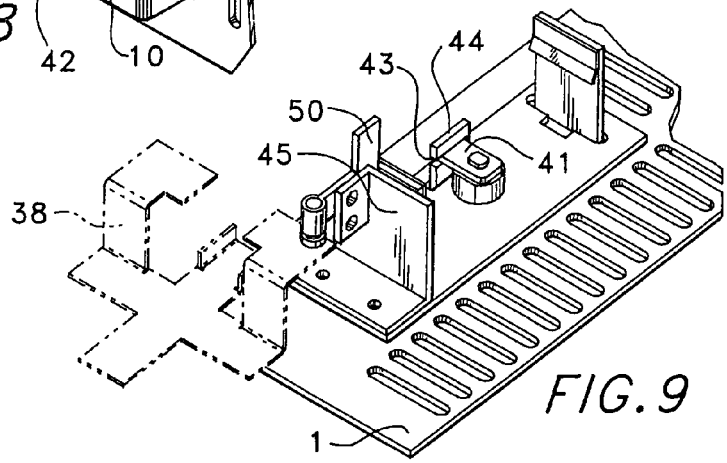
FIG. 9 is a perspective view of the underside of the panel lifter showing a second embodiment of the panel lifter locking mechanism and an adjustable corner lock.
Figure 10:
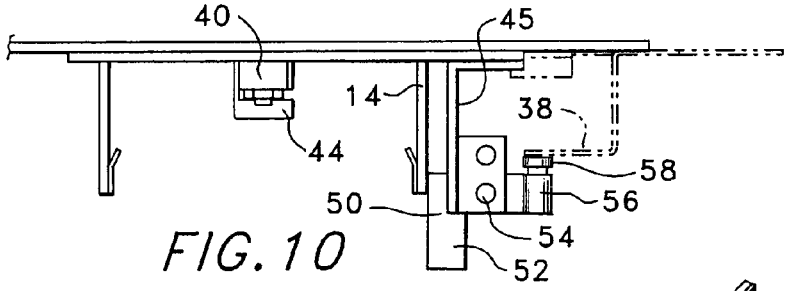
FIG. 10 is a side view of the perspective view shown in FIG. 9.
Figure 11:
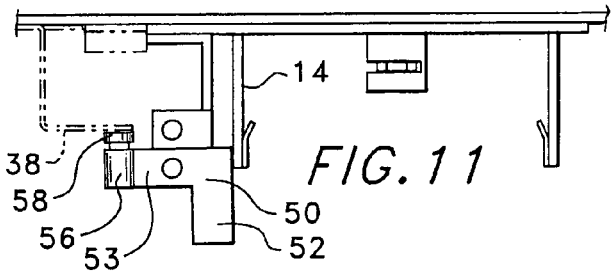
FIG. 11 is an opposite side view from view shown in FIG. 10.

As shown in FIGS. 9, 10, and 11, when the tab 41 on the lock 40 of the second embodiment is turned into a slot 46 in the latch 44 the top wall 12 of the panel lifter is recessed into the panel so as to provide a flush panel load supporting surface for rolling, sliding or walking. In this locked position, the side walls 13, 14 of the panel lifter 12 engage the second end 52 of the lever arm 50 downwardly forcing the lever arm 50 to pivot on the angle bracket 45 and the corner lock 58 to bias forcefully against the adjustable pedestal support 38 to anchor, and if desired, lock the panel in place to provide a secure enclosed environment.

Figure 12:
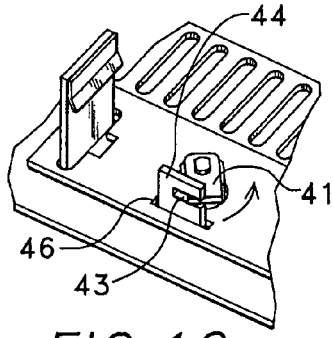
FIG. 12 is an underside perspective view of the second embodiment for the locking mechanism showing the lock releasing from a latch.
Figure 13:
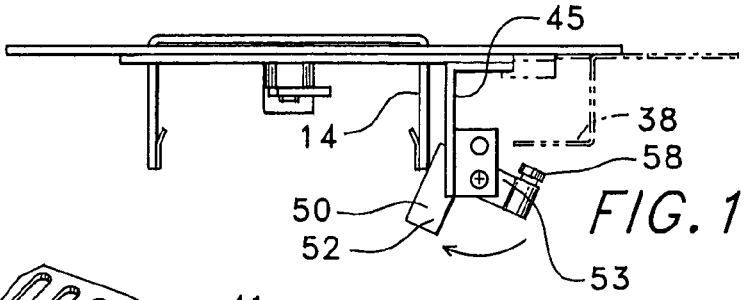
FIG. 13 is a side view of the panel lifter moving upwardly to disengage the corner lock.
Figure 14:
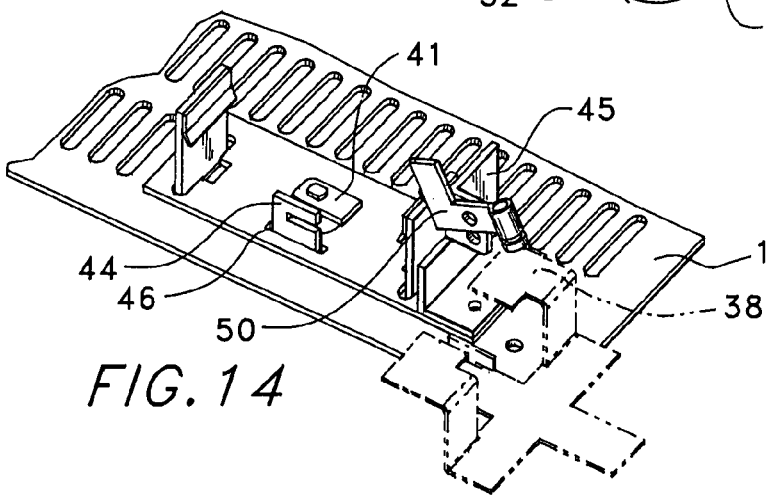
FIG. 14 is an underside perspective view of the illustration in FIG. 13.
Figure 15:
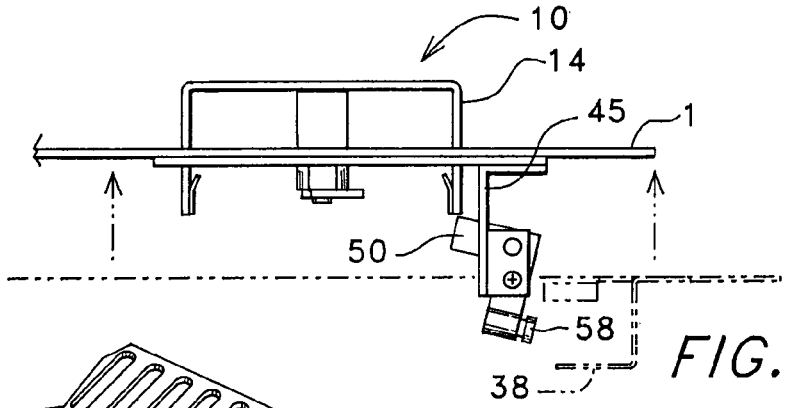
FIG. 15 is a side view of the panel lifter in a raised position with the corner lock fully disengaged from the pedestal.
Figure 16:
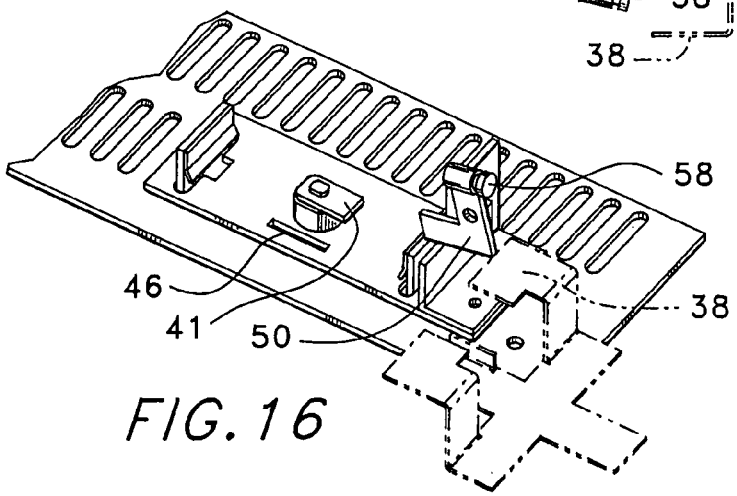
FIG. 16 is an underside perspective view of the illustration in FIG. 15.

The force of the corner lock 58 against the pedestal member 38 is easily withdrawn for removal of the panel 1. FIG. 12 shows an underside perspective view of the second embodiment of the locking mechanism showing the locking tab 41 releasing from the latch 44. To remove the panel 1 from the pedestal 38 one turns the key lock an urges the panel lifter 10 in an upward direction. As shown in FIGS. 13 and 14, as the panel lifter 10 is urged upward, a side wall 14 of the panel lifter 10 releases a tension on the lever arm second end 52 whereby the lever arm first end 53 and corner lock 58 pivot away from the pedestal support 38. In FIGS. 15 and 16 the panel lifter 10 is shown in a fully raised position for removing the panel 1 and the corner lock 58 has fully released from the underside of a two tier adjustable support 38.

While the present invention has been described in connection with the illustrated embodiments, it will be appreciated and understood that modifications may be made without departing, from the true spirit and scope of the invention.

I claim:

1. An interchangeable raised access floor panel, comprising:

(a) a floor panel plate having four right angle corner portions, four lateral edge portions, a substantially flat upper load bearing surface, and a lower surface, the lower surface in order to support the floor panel plate at each of the four corner portions on a pedestal support head member, the upper load bearing surface and the lower surface defining a floor panel plate thickness;

(b) at least one handle movably connected to the floor panel plate adjacent to at least one of the lateral edge portions, the handle having a substantially rectangular top plate, and two opposing vertical side plates, the top plate having a thickness substantially equal to the floor panel plate thickness and a cut-out portion in order to lift the handle, the side plates each having an upper portion connected to the top plate and a lower portion having a lug in order to bias against the lower surface of the floor panel plate when the handle is operated upwardly in a lifting position; and (c) a substantially rectangular clear hole in the floor panel top plate positioned in order to receive the handle top plate when the handle is operated downwardly in a position wherein the floor panel top plate is planar to the upper load bearing surface.

2. The interchangeable access floor panel according to claim 1, further comprising, (a) four threaded collars in the floor panel plate, one each of the collars positioned adjacent to one of the corner portions; and (b) four set screws, each having an upper tool receiving end and a lower foot end, the lower foot end biasing against the pedestal support head for urging the set screws against the pedestal support head when the set screws are operated in order to permit vertical adjustment of the floor panel plate in relation to the pedestal support head.

3. A raised floor access panel, comprising:

(a) a substantially flat floor panel having an upper load supporting surface and a lower surface to be supported on a plurality of pedestal support members each adjacent to a corner of the floor panel;

(b) at least one panel lifter handle having a top wall and two side walls, the side walls slidably extending through a first and second slots in a plate rigidly attached to the lower surface of the floor panel for vertical travel of the panel lifter handle top wall and side walls upwardly, through a generally rectangular floor panel recess for removing the floor panel from the pedestal support members; and (c) an angle bracket extending downwardly from an underside of the plate and an adjustable corner lock pivotally mounted on the bracket, the corner lock on a lever arm actuated by a side wall of the panel lifter handle to forcefully bias the panel against the pedestal.

4. The raised floor access panel according to claim 3 further comprising, a lock mounted in the top wall of the panel lifter handle and extending through a hole in the plate for securing the corner lock against the pedestals.

5. The raised floor access panel according to claim 3 further, comprising a panel lock mounted through a hole in the plate, the hole circumscribing the lock in the top wall of the panel lifter handle, and a latch attached to the top wall of the panel lifter handle and extending through a third slot in the plate for securing the panel corner lock against the pedestal members.

* * * * *